US007758355B2

(12) United States Patent
Higeta et al.

(10) Patent No.: US 7,758,355 B2
(45) Date of Patent: Jul. 20, 2010

(54) CONNECTOR

(75) Inventors: Takuya Higeta, Tokyo (JP); Yoshinori Yabe, Tokyo (JP)

(73) Assignee: DDK Ltd. (JP)

( * ) Notice: Subject to any disclaimer, the term of this patent is extended or adjusted under 35 U.S.C. 154(b) by 46 days.

(21) Appl. No.: 12/333,544

(22) Filed: Dec. 12, 2008

(65) Prior Publication Data

US 2009/0170368 A1 Jul. 2, 2009

(30) Foreign Application Priority Data

Dec. 27, 2007 (JP) ..... 2007-335918

(51) Int. Cl.
*H01R 12/00* (2006.01)

(52) U.S. Cl. ..... 439/79; 439/660; 439/733.1

(58) Field of Classification Search ..... 439/79, 439/660, 80, 733.1
See application file for complete search history.

(56) References Cited

U.S. PATENT DOCUMENTS 7,217,159 B2 * 5/2007 Chung ..... 439/607.01
2002/0197894 A1 * 12/2002 Konno et al. ..... 439/79
2003/0096517 A1 * 5/2003 Ho ..... 439/79
2003/0104714 A1 * 6/2003 Yeh ..... 439/79
2003/0207600 A1 * 11/2003 Ho ..... 439/79
2004/0023531 A1 * 2/2004 Wu ..... 439/79

FOREIGN PATENT DOCUMENTS

JP 5-79867 10/1993
JP 6-13064 2/1994
JP 2001-006780 1/2001

* cited by examiner

*Primary Examiner*—Hien Vu
(74) *Attorney, Agent, or Firm*—Dickstein Shapiro LLP

(57) ABSTRACT

In the case that a distance between contact portions and fixed portions of contacts of a connector is 2 mm or more, the contacts are each provided with an engaging portion in the proximity of the fixed portion, and the housing is provided in the inserting holes for the contacts with anchoring portions at locations corresponding to the engaging portions of the contacts so that the engaging portions of the contacts engage the anchoring portions of the housing, thereby preventing the contact portions of the contacts from being deformed and collapsed into a fitting opening by a connecting object, and preventing the contacts from buckling or being damaged and hence preventing any defective electrical connection.

3 Claims, 6 Drawing Sheets

CONNECTOR

BACKGROUND OF THE INVENTION

This invention relates to a connector for use in electric and electronic appliances such as a server, personal computer (PC), hard disk drive (HDD) and the like, and more particularly to a connector with a structure for preventing contact portions of contacts from being deformed into a fitting opening for inserting a connecting object such as a flexible printed circuit board, in the case that a distance between the contact portions and fixed portions of the contacts is 2 mm or more.

In many cases, a connector generally comprises contacts made of a metal in continuity with a connecting object, and a housing made of an insulating material for keeping the contacts insulated from one another. The contacts each comprise a contact portion adapted to contact the connecting object, a fixed portion fixed to the housing and a connection portion to be connected to a substrate.

As examples of connectors, incorporated herein are Japanese Utility Model Application Opened No. H05-79,867 (Patent Literature 1), Japanese Utility Model Application Opened No. H06-13,064 (Patent Literature 2), and Japanese Patent Application Opened No. 2001-6,780 (Patent Literature 3).

Patent Literature 1

According to the abstract of the Japanese Utility Model Application Opened No. H05-79,867, disclosed is an electrical connector of a cold welding type including conductive contacts (1) each having a U-slit at its terminal, a body (2) for accommodating, holding and fixing the contacts (1), and a cover (3) pushing a cable (4) against the terminals (13) of said contacts (1) for press-fitting conductors of the cable (4) into the U-slits (131) of the terminals (13) of said contacts (1), wherein the body (2) is provided with extending pedestals (21) in the proximity of the U-slits (131) of the terminals (13) of the contacts (1) rising from the body, the extending pedestals (21) having a height enabling the connected cable to be embraced between the pedestals (21) and the cover (3) for the purpose of preventing the connected cable from loosening or disconnecting.

Incidentally, the claim 1 of this case recites an electrical connector of a cold welding type, including conductive contacts each having a U-slit at its terminal, a body for accommodating, holding and fixing the contacts, and a cover for pushing said cable to the terminals of said contacts for press-fitting conductors of the cable into the U-slits of the terminals of said contacts, wherein said body is provided with pedestals extending from said body in the proximity of the U-slits of the terminals of the contacts rising from said body.

Patent Literature 2

According to the abstract of the Japanese Utility Model Application Opened No. H06-13,064, disclosed is a connector with a number of contacts press-fitted and fixed in a row in a housing of a synthetic resin, wherein the contacts are each formed with a press-fitting protrusion, and the press-fitting protrusions extend in the directions substantially perpendicular to the direction in which the contacts are arranged in alignment with one another, for the purpose of obtaining a connector whose housing is not warped.

Incidentally, claim 1 of this case recites a connector with a number of contacts press-fitted and fixed in a row in a housing of a synthetic resin, wherein said number of contacts are each provided with a press-fitting protrusion on a press-fitting part of the contact to be press-fitted in the housing, and the press-fitting protrusions extend in the directions perpendicular to the direction in which the contacts are arranged in alignment with one another. Claim 2 recites the connector with contacts press-fitted as claimed in claim 1, wherein the housing has inserting grooves for inserting contacts portions of the contacts adapted to contact mating contacts, and the press-fitting protrusions of the contacts are provided at locations which cause contact portions of said contacts to separate from bottoms of the inserting grooves.

Patent Literature 3

According to the abstract of the Japanese Patent Application Opened No. 2001-6,780, this invention has an object to provide an electrical connector capable of being miniaturized and improving reliability in soldering connection and having terminals arranged in multistage. Disclosed is an electrical connector including a plurality of terminals 5, 11 each formed by working a metal plate into a substantially band-shape and arranged on each of arrangement surfaces in plural steps and in parallel with each other formed in an insulating housing 1 in a manner that a contact portion 7, 12 forming one end of the terminal is positioned on the arrangement surface, and a leg 9, 14 extending from the other end of the terminal on each of the corresponding steps is formed with a connection portion 10, 15 extending from the housing and located in the same plane, wherein at least one terminal 5 of the terminals on the respective steps located in corresponding positions is formed with a plurality of legs 9 at an interval in its width direction of the terminal, and the terminal 11 on the other step has a leg 14 positioned within said interval in said width direction, and wherein the connection portions 10, 15 of the terminals on the respective steps located the corresponding positions are positioned in substantially the same row in said width direction on one plane.

Incidentally, claim 1 of this case recites an electrical connector including a plurality of terminals each formed by working a metal plate into a substantially band-shape and arranged on each of arrangement surfaces in plural steps and in parallel with each other formed in an insulating housing 1 in a manner that a contact portion forming one end of the terminal is positioned on the arrangement surface, and a leg extending from the other end of the terminal on each of the corresponding steps is formed with a connection portion extending from the arrangement surface and located in the same plane, wherein at least one terminal of the terminals on the respective steps located in corresponding positions is formed with a plurality of legs at an interval in its width direction of the terminal, and the terminal on the other step has a leg positioned within said interval in said width direction, and wherein the connection portions of the terminals on the respective steps located the corresponding positions are positioned in substantially the same row in said width direction on one plane. Claim 2 recites the electrical connector with terminals arranged in multistage as claimed in claim 1, wherein the terminals having a plurality of the legs are power-supply terminals, and the other terminals are signal terminals. Claim 3 recites the electrical connector with terminals arranged in multistage as claimed in claim 2, wherein the power-supply terminals have the two legs whose ends are connection portions to be connected to circuits of a circuit substrate by soldering. Claim 4 recites the electrical connector with terminals arranged in multistage as claimed in claim 2, wherein the power-supply terminals have the three legs whose ends are connection portions to be connected to circuits of a circuit substrate by soldering. Claim 5 recites the electrical connector with terminals arranged in multistage as claimed in claim 2, wherein the power-supply terminals have the four legs whose ends are connection portions to be connected to circuits of a circuit substrate by soldering.

With the contacts disclosed in the above Patent Literatures 1 to 3, the contact portions of the contacts adapted to contact a connecting object are each arranged so that the wall of the housing (insulator) is located on the opposite side of the contact portion (refer to FIGS. 1, 4 and 5 of the Patent Literature 1, FIG. 1 of the Patent Literature 2, and FIG. 2 of the Patent Literature 3), and there are contacts having a comparatively long distance between the contact portions and fixed portions.

When the distance between the contact portions and fixed portions is long, the contact portion of the contact is a free end so that the contact portion tends to collapse about the fixed portion as a fulcrum toward the center of a fitting opening by a connecting object in a cantilevered manner. Such a collapse of the contact portions results in buckling and damage of the contacts and further defective or failed electrical connection.

SUMMARY OF THE INVENTION

In view of the problems of the prior art, the invention has been completed to solve these problems, and the present invention has an object to provide a connector capable of preventing contact portions of contacts from being collapsed into a fitting opening for a connecting object thereby preventing the contacts from buckling or being damaged and hence preventing any defective or failed electrical connection.

The object of the invention can be achieved by the connector 10 into which a connecting object is detachably inserted and removed, said connector including a required number of contacts 14 each having a contact portion 16 adapted to contact said connecting object, a fixed portion 18 to be fixed to a housing 12, and a connection portion 20 to be connected to a substrate, and the housing 12 having inserting holes 30 for arranging and holding said contacts 14 inserted therein, a fitting opening 26 into which said connecting object is inserted, and a wall 28 for preventing the contact portions 16 of said contacts 14 from being deformed and collapsed, constructed according to the invention in that in the case that a distance between the contact portions 16 and the fixed portions 18 of said contacts 14 is 2 mm or more, said contacts 14 are each provided with an engaging portion 22 in the proximity of said fixed portion 18, and said housing 12 is provided in said inserting holes 30 with anchoring portions 34 at locations corresponding to said engaging portions 22 of said contacts 14 so that the engaging portions 22 of said contacts 14 engage the anchoring portions 34 of said housing 12, thereby preventing the contact portions 16 of said contacts 14 from being deformed or collapsed into said fitting opening 26.

The connector 10 as claimed in claim 2 is so constructed that the engaging portions 22 are each formed as a step 221, and the anchoring portions 34 in the inserting holes 30 of said housing 12 are each formed as an extending wall 341 so that the steps 221 of said contacts 14 engage the extending walls 341 of said housing 12, thereby preventing the contact portions 16 of said contacts 14 from being collapsed into said fitting opening 26.

As can be seen from the above description, the connector 10 according to the invention can bring about the following significant functions and effects. (1) A connector in claim 1 is the connector 10 into which a connecting object is detachably inserted and removed, said connector including a required number of contacts 14 each having a contact portion 16 adapted to contact said connecting object, a fixed portion 18 to be fixed to a housing 12, and a connection portion 20 to be connected to a substrate, and the housing 12 having inserting holes 30 for arranging and holding said contacts 14 inserted therein, a fitting opening 26 into which said connecting object is inserted, and a wall for preventing the contact portions 16 of said contacts 14 from being deformed and collapsed, wherein in the case that a distance between the contact portions 16 and the fixed portions 18 of said contacts 14 is 2 mm or more, said contacts 14 are each provided with an engaging portion 22 in the proximity of said fixed portion 18, and said housing 12 is provided in said inserting holes 30 with anchoring portions 34 at locations corresponding to said engaging portions 22 of said contacts 14 so that the engaging portions 22 of said contacts 14 engage the anchoring portions 34 of said housing 12, thereby preventing the contact portions 16 of said contacts 14 from being deformed and collapsed into said fitting opening 26. Accordingly, the contact portions 16 of the contacts 14 are prevented from being collapsed into the fitting opening by the connecting object, and even when the connection portions 20 of the contacts 14 are being remedied or modified into a ordinary shape, the contact portions 16 are never deformed or collapsed so that the buckling and damage of the contacts 14 are completely prevented, thereby fully preventing any defective or failed electrical connection.

(2) According to the connector 10 as claimed in claim 2, the engaging portions 22 are each formed as a step 221, and the anchoring portions 34 in the inserting holes 30 of said housing 12 are each formed as an extending wall 341 so that the steps 221 of said contacts 14 engage the extending walls 341 of said housing 12, thereby preventing the contact portions 16 of said contacts 14 from being deformed into said fitting opening 26. Therefore, the contact portions 16 of the contacts 14 are prevented from being collapsed into the fitting opening by the connecting object, and even when the connection portions 20 of the contacts 14 are being remedied or modified into a desired shape, the contact portions 16 are never deformed or collapsed so that the buckling and damage of the contacts 14 are completely prevented, thereby fully preventing any defective or failed electrical connection.

According to the important aspect of the invention, the contacts each comprise the engaging portion 22 in the proximity of the fixed portion 18 and the housing 12 is provided in the inserting holes 30 with the anchoring portions 34 at locations corresponding to the engaging portions 22 of the contacts 14 so that the engaging portions 22 engage the anchoring portions 34, respectively. In this way, the contact portions 16 of said contacts 14 can be prevented from being deformed into the fitting opening 26 for the connecting object, when the distance between the contact portions 16 and the fixed portions 18 of the contacts 14 is 2 mm or more.

In other words, the engaging portions 22 of the contacts 14 are brought into engagement with the anchoring portions 34 of the housing 12 at locations on the side of the contact portions 16 with respect to the fixed portions 18, thereby providing a supporting function for the contact portions of the contacts.

The invention will be more fully understood by referring to the following detailed specification and claims taken in connection with the appended drawings.

DESCRIPTION OF THE PREFERRED EMBODIMENTS

Figure 1A:
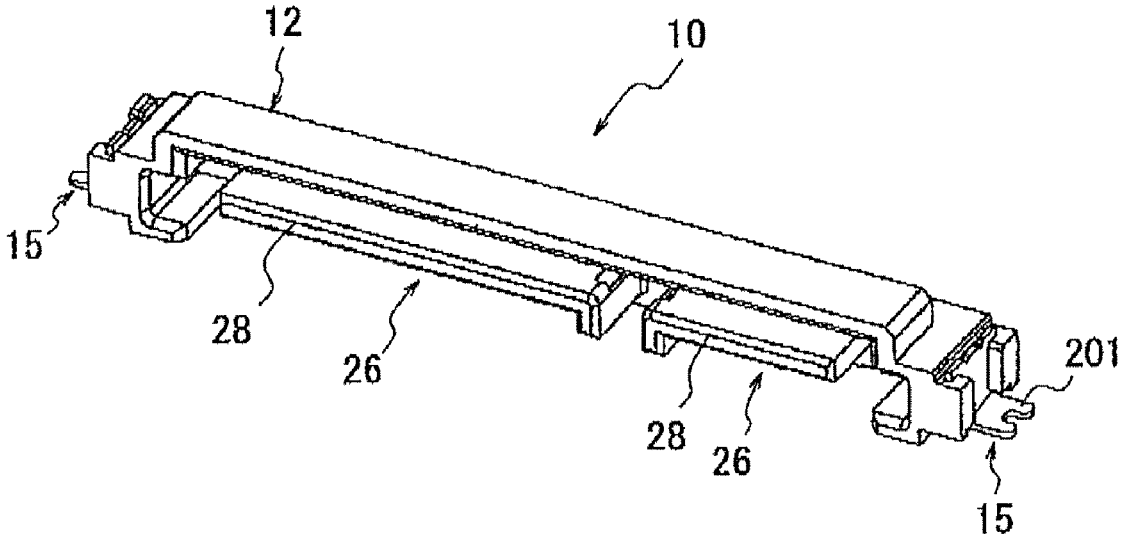
FIG. 1A is a perspective view of the connector according to the invention viewed from the above on the side of the fitting opening.
Figure 1B:
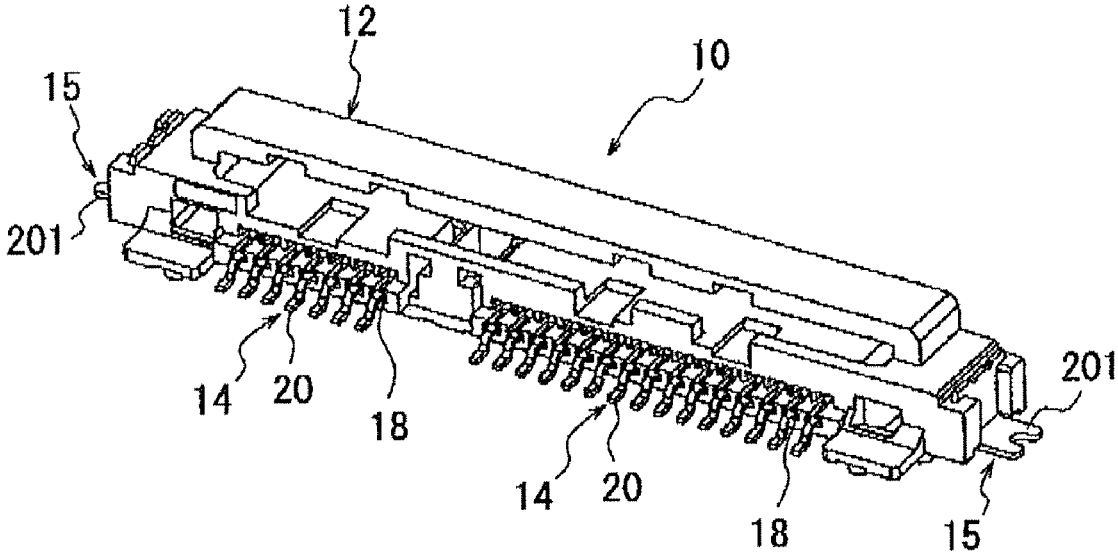
FIG. 1B is a perspective view of the connector viewed from the above on the opposite side of the fitting opening.
Figure 2A:
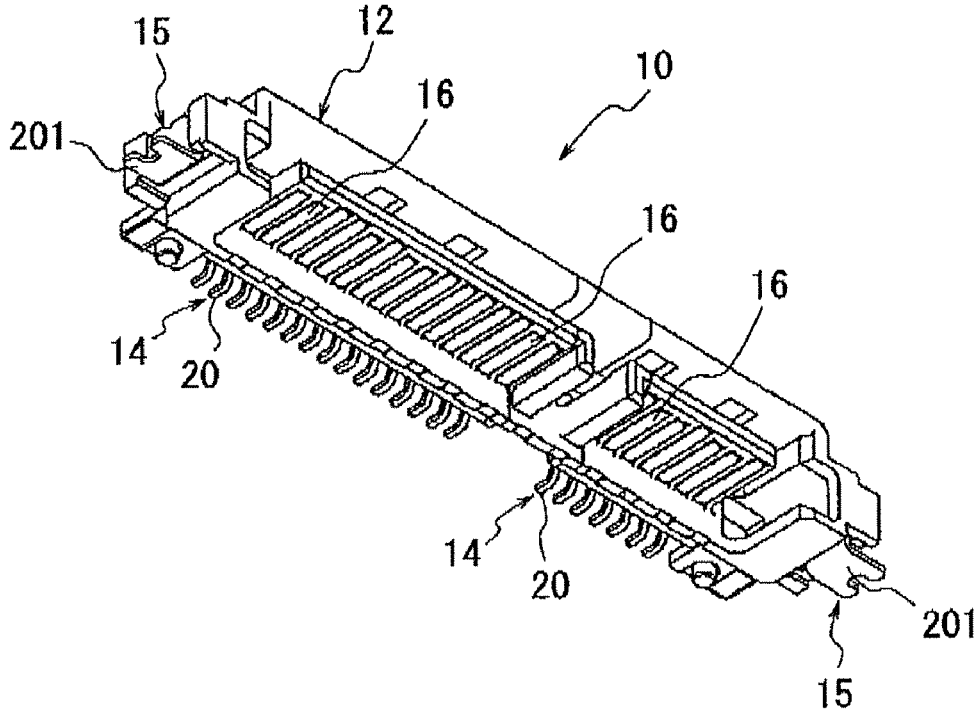
FIG. 2A is a perspective view of the connector viewed from the below on the side of the fitting opening.
Figure 2B:
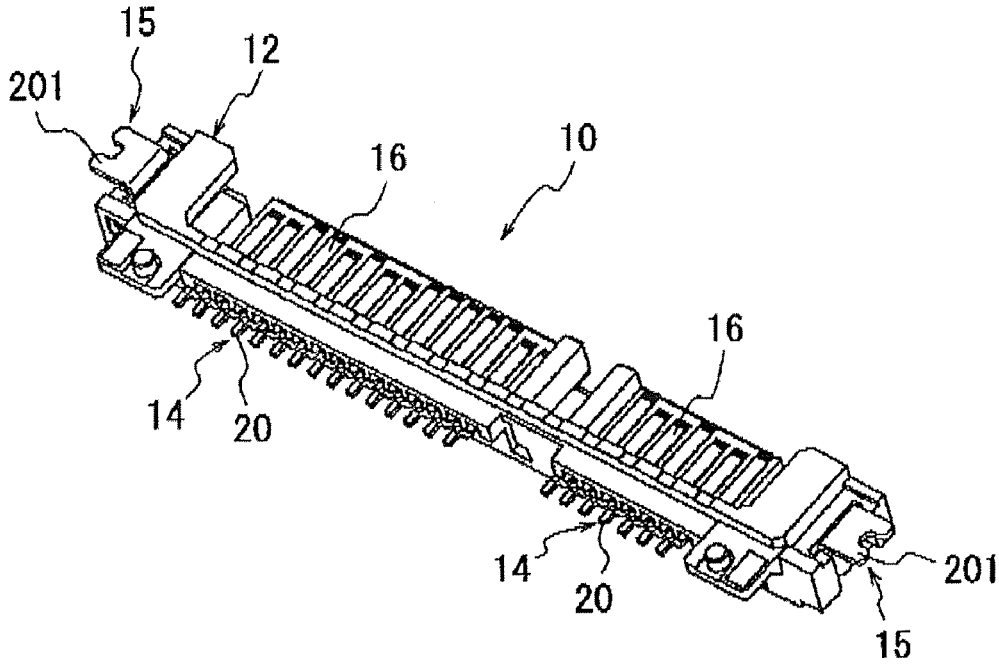
FIG. 2B is a perspective view of the connector viewed from the below on the opposite side of the fitting opening.
Figure 3A:
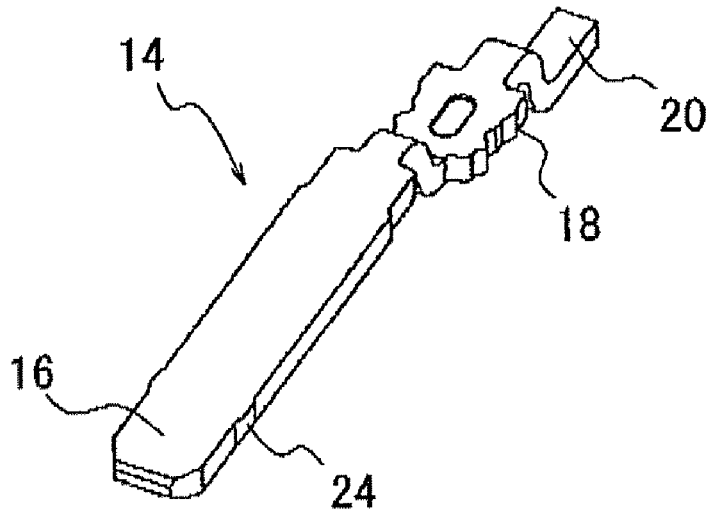
FIG. 3A is a perspective view of a contact viewed from the above on the side of its contact portion.
Figure 3B:
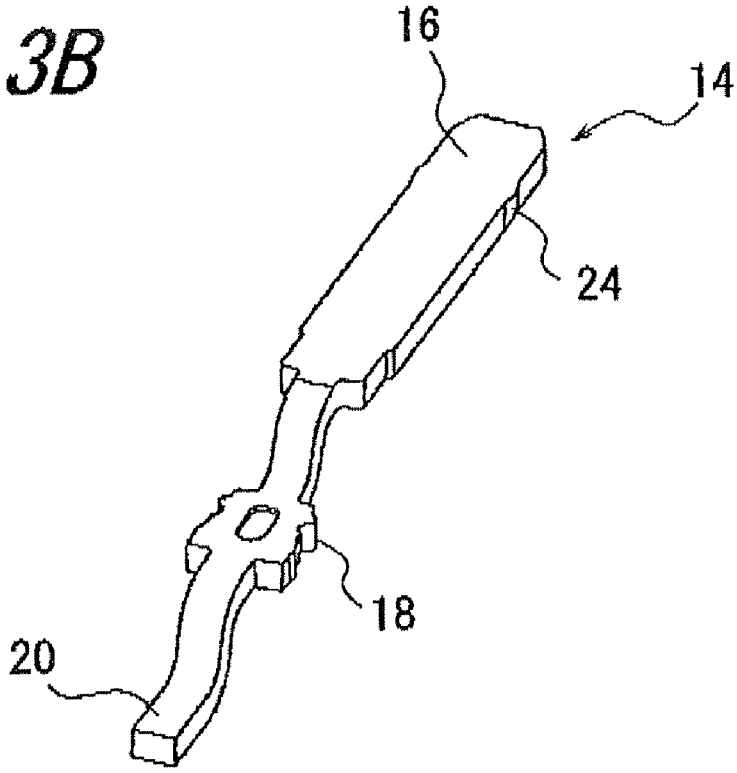
FIG. 3B is a perspective view of the contact viewed from the above on the side of its connection portion.
Figure 4A:
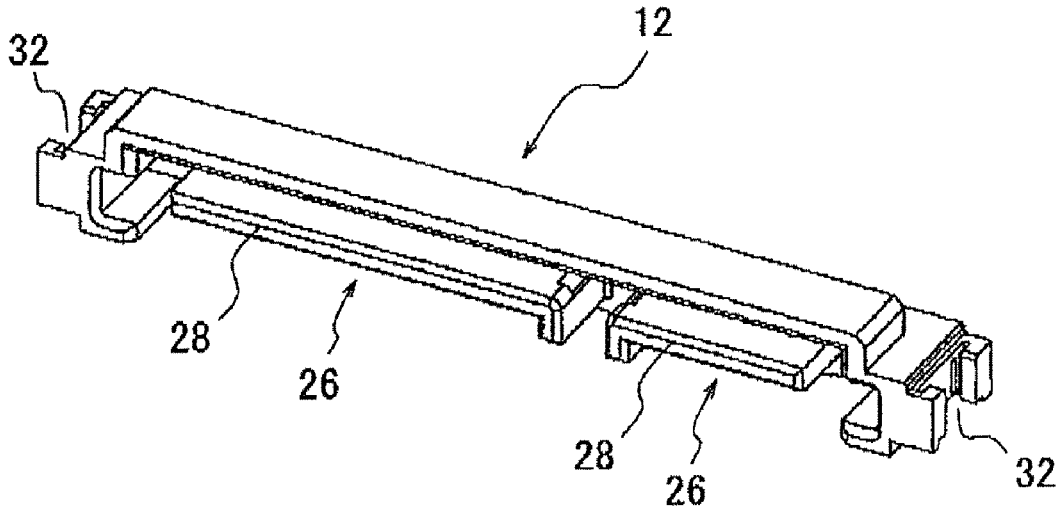
FIG. 4A is a perspective view of a housing viewed from the above on the side of the fitting opening.
Figure 4B:
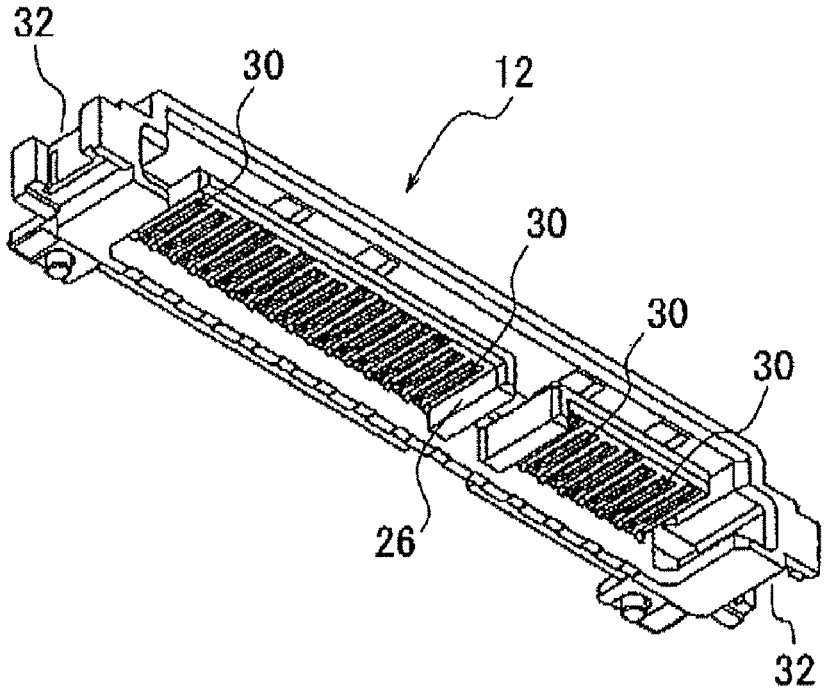
FIG. 4B is a perspective view of the housing viewed from the below on the side of the fitting opening.
Figure 5A:
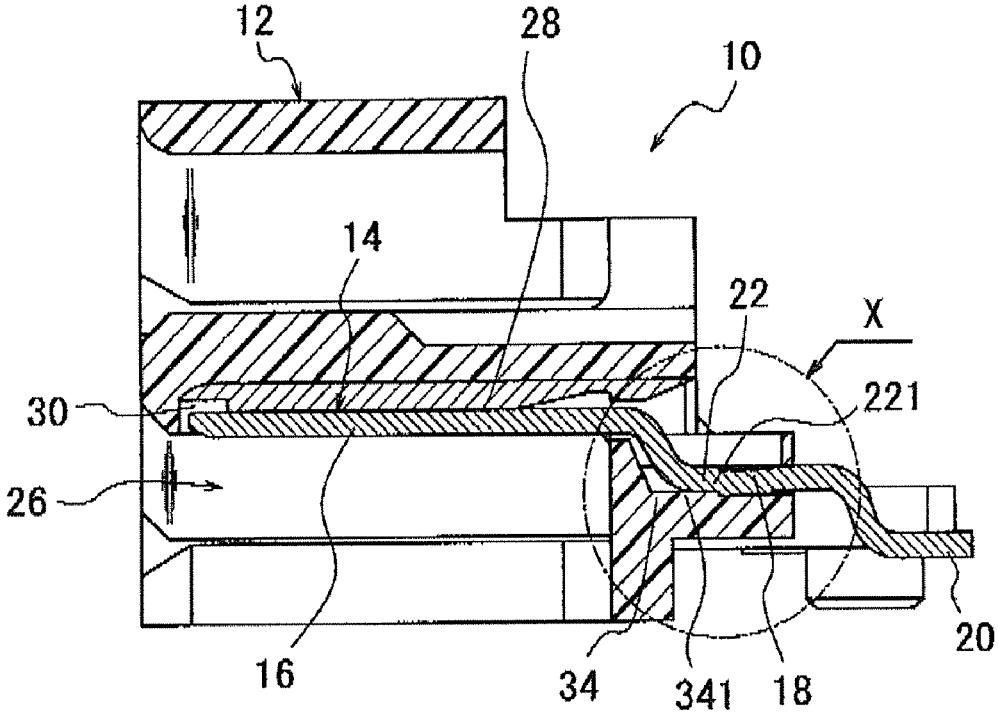
FIG. 5A is a cross-sectional view of the connector according to the invention, taken along the center of one inserting hole.
Figure 5B:
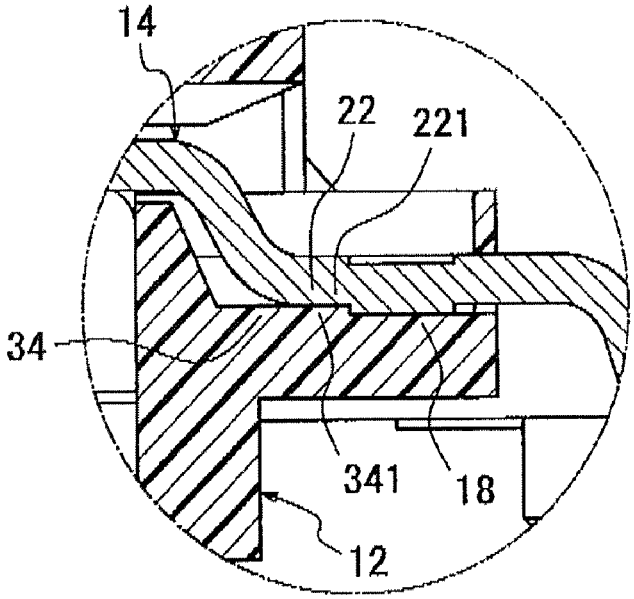
FIG. 5B is an enlarged view of a portion of a circle X in FIG. 5A.
Figure 6:
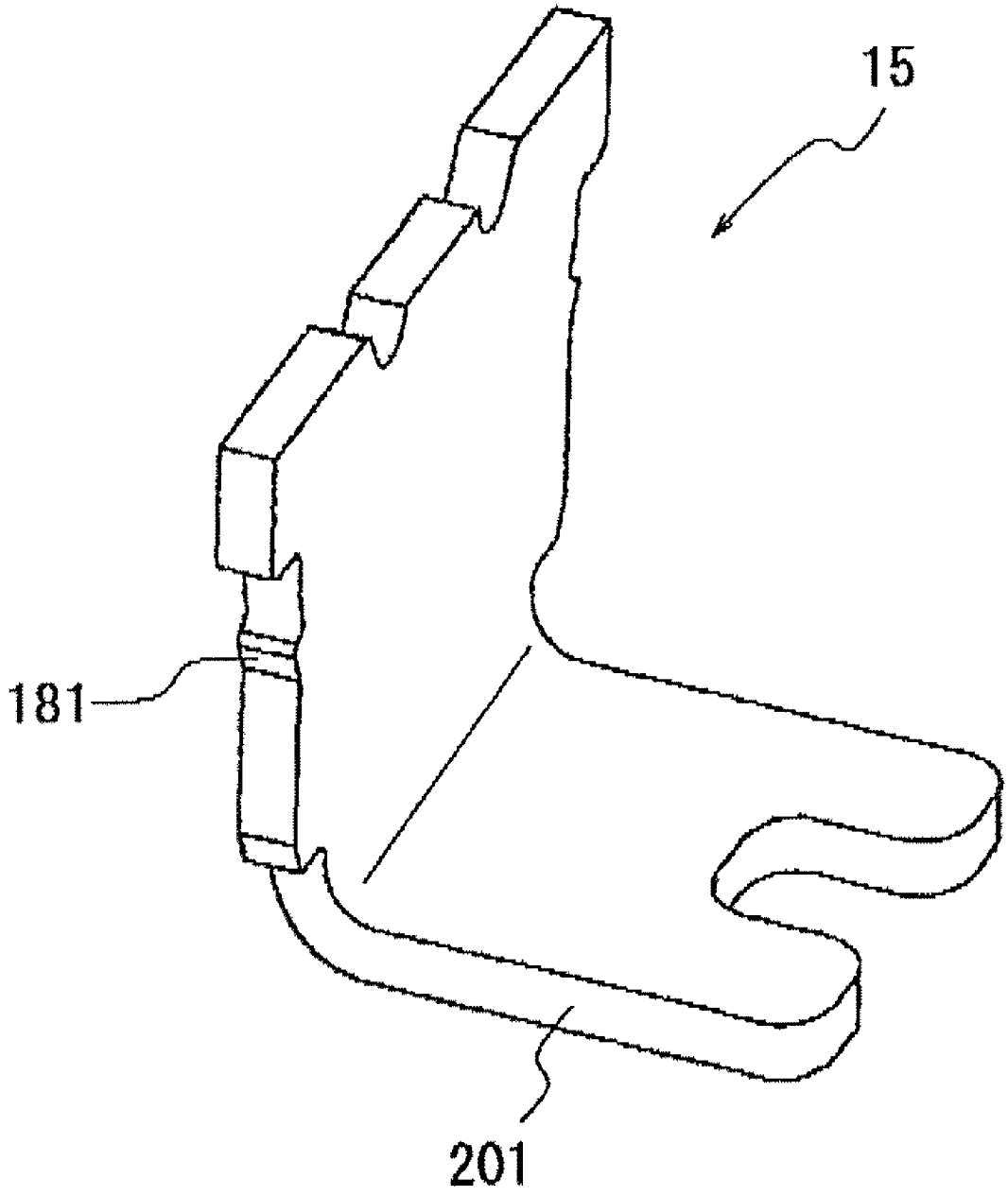
FIG. 6 is a perspective view of a fixture.

One embodiment of the connector according to the invention will be explained with reference to FIGS. 1A to 6. FIG. 1A is a perspective view of the connector according to the invention viewed from the above on the side of its fitting opening, and FIG. 1B is a perspective view of the connector viewed from the above on the opposite side of the fitting opening. FIG. 2A is a perspective view of the connector viewed from the below on the side of the fitting opening, while FIG. 2B is a perspective view of the connector viewed from the below on the opposite side of the fitting opening. FIG. 3A is a perspective view of a contact viewed from the above of its contact portion, and FIG. 3B is a perspective view of the contact viewed from the above of its connection portion FIG. 4A is a perspective view of a housing viewed from the above on the side of its fitting opening, while FIG. 4B is a perspective view of the housing viewed from the below on the side of the fitting opening. FIG. 5A is a cross-sectional view of the connector according to the invention, taken along the center plane of an inserting hole, and FIG. 5B is an enlarged sectional view of the portion shown by a circle X in FIG. 5A. FIG. 6 is a perspective view of a fixture.

The connector 10 according to the invention mainly comprises a housing 12, and contacts 14, and further fixtures 15 in the present embodiment.

Components of the connector 10 according to the invention will be explained with reference to the drawings. First, the contacts 14 will be explained. The contacts 14 are made of a metal and formed by means of the press-working of the known technique. Preferred metals from which to form said contacts 14 include brass, beryllium copper, phosphor bronze and the like which comply with the requirements as to springiness, electric conductivity, and the like. The contact 14 is substantially in the form of a crank as shown in FIGS. 3A and 3B, and mainly comprises a contact portion adapted to contact a connecting object, a fixed portion to be fixed to the housing, a connection portion to be connected to a substrate, and an engaging portion. In the illustrated embodiment, the contacts 14 are inserted into inserting holes of said housing, respectively. In the illustrated embodiment, two kinds of the contacts 14 are used for the purpose of obtaining a sequence type or structure. The difference between the two kinds of contacts is in the length from the fixed portion 18 to the contact portion 16.

Said contact portion 16 is adapted to contact a connecting object and is shaped to be compatible with the shape of the connecting object. The contact portion 16 may be suitably designed so as to be easy to contact the connecting object and to enable a stable contact pressure. Said fixed portion 18 is to be fixed to said housing 12, and its position and size may be suitably designed in consideration of its holding force and strength. Said connection portion 20 is to be connected to the substrate 60 and may be suitably designed to be compatible with the substrate 60. Although the connection portion 20 is of a surface mounting type (SMT) in the illustrated embodiment as shown in FIGS. 3A and 3B, it may be of a dip type.

Said contact 14 is provided with an engaging portion 22 in the proximity of the fixed portion 18 on the side of the contact portion 16 with respect to the fixed portion (FIGS. 5A and 5B) in order to prevent the contact portion 16 of said contact 14 from falling down or being collapsed into the fitting opening 26 in the case that a distance between the contact portion 16 and the fixed portion 18 is 2 mm or more. The position and size of said engaging portion 22 may be any ones insofar as the engaging portion 22 achieves its function (prevention of deformation of the contact portion). In the illustrated embodiment, a step 221 is provided as the engaging portion taking into account facility in working. The size of the step 221 is 0.02 to 0.07 mm in consideration of the function, workability, and the like.

In order to prevent the contact portion 16 from falling down or being collapsed, moreover, said contact portion 16 is provided with extending pieces 24 on both sides in the width direction of the contact so that the extending pieces 24 are hooked or latched on walls of the inserting hole 30 of said housing 12.

The housing 12 will then be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyxmide (66 PA or 46 PA), liquid crystal polymer (LCP), polycarbonate (PC) and the like and synthetic materials thereof.

Said housing 12 is formed with inserting holes 30 for installing a required number of the contacts therein, respectively, by press-fitting, hooking (lancing), welding or the like.

The housing is formed in said inserting holes 30 with anchoring portions 34 at locations corresponding to said engaging portions 22 so that the anchoring portions 34 engage said engaging portions 22, respectively, in order to prevent the contact portions 16 of said contacts 14 from falling down or being deformed and collapsed into the fitting opening 26 in the case that the distance between the contact portions 16 and the fixed portions 18 is 2 mm or more. The positions and size of said anchoring portions 34 may be any ones so long as the anchoring portions 34 achieve their function (prevention of deformation of the contact portions). In the illustrated embodiment, extending walls 341 are provided as anchoring portions 34 taking into account workability and strength. The size of the extending walls 341 of said housing 12 my be any one insofar as they engage said engaging portions 22 and such an engagement can prevent the contact portions 16 of said contacts 14 from being deformed into said fitting opening 26 and farther prevent the contact portions 16 from being deformed when said connection portions 20 are being remedied or modified into a desired shape. In the illustrated embodiment, the height of the extending walls is 0.01 to 0.07 mm.

Said housing 12 is formed at both the longitudinal ends with mounting holes or slits 32 for inserting and fixing said fixtures 15 therein. The size of the mounting holes or slits 32 may be any one insofar as the fixtures 15 can be inserted and fixed therein and may be suitably designed in consideration of holding force, strength, and the like.

Moreover, said housing 12 is formed with the fitting opening 26 into which the connecting object is inserted. The size and shape of said fitting opening 26 may be suitably designed to be compatible with the connecting object.

The housing 12 is further provided in said fitting opening 26 with a fitting projection 28 for holding the contact portions 16 of said contacts 14. The fitting projection 28 consists of two parts compatible with said connecting object, and each of the two parts is substantially L-shaped for preventing the connecting object from being erroneously inserted as can be seen from FIG. 1A. The fitting projection 28 is adapted to contact the opposite faces of the contact portions 16 of said contacts 14.

Finally, the fixtures 15 will be explained. Said fixtures 15 are made of a metal and formed by means of the press-working of the known technique. Preferred metals from which to form said fixtures 15 include brass, beryllium copper, phosphor bronze and the like which comply with the requirements as to springiness, electric conductivity, strength, and the like. Said fixtures 15 are fixed to the substrate 60 to reinforce the mounted strength of the connector 10. The fixture 15 is of an L-shape and comprises a fixed portion 181 to be fixed to said housing 12 and a connection portion 201 to be connected to the substrate 60. The shape and size of the fixtures 15 may be any ones so long as they can be securely fixed to the housing 12 and may be suitably designed taking into account the strength and workability of the fixtures, miniaturization of the connector 10, and the like. The shape and size of the connection portions 201 may be any ones insofar as the fixtures can enhance the mounted strength of the connector 10, and may be suitably designed in consideration of the mounted strength, workability, miniaturization of the connector 10, an occupied area of the substrate, and the like.

Examples of applications of the present invention are connectors for use in electric and electronic appliances, such as a server, personal computer (PC), hard disk drive (HDD), and the like, and particularly connectors having a structure for preventing contact portions of contacts from falling down or being deformed into a fitting opening for a connecting object in the case that a distance between the contact portions and fixed portions of the contacts is 2 mm or more.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector into which a connecting object is detachably inserted and removed, said connector including a required number of contacts each having a contact portion adapted to contact said connecting object, a fixed portion to be fixed to a housing, and a connection portion to be connected to a substrate, and the housing having inserting holes for arranging and holding said contacts inserted therein, a fitting opening into which said connecting object is inserted, and a wall for preventing the contact portions of said contacts from being collapsed, wherein at least some of said contacts are each provided with projection pieces on both sides at a near front end thereof for hooking in walls of the respective insertion hole an engaging portion in the proximity of said fixed portion, and anchoring portions are provided in said inserting holes at locations corresponding to said engaging portions, wherein the engaging portions are each formed as a first step, and the anchoring portions are each formed as an extending wall with a second step so that the first step of each said contact provided with an engaging portion fittedly engages the respective second step of the extending walls to prevent the contact portions of said contacts from being deformed into said fitting opening.

2. The connector as claimed in claim 1, wherein back side of the contact portion is supported by a fitting projection of the housing to prevent deform or collapse of said contacts.

3. The connector as claimed in claim 1, wherein said at least some of said contacts provided with said engaging portion include contacts having a distance between the respective contact portions and fixed portions of 2 mm or more.

* * * * *